US008499714B2

(12) United States Patent
Bortolato

(10) Patent No.: US 8,499,714 B2
(45) Date of Patent: Aug. 6, 2013

(54) POWDER PAINTING CABIN

(75) Inventor: Giovanni Bortolato, Carate Brianza-Monza E Brianza (IT)

(73) Assignee: Lasa Impianti S.R.L., Carate Brianza-Monza E Brianza (IT)

( * ) Notice: Subject to any disclaimer, the term of this patent is extended or adjusted under 35 U.S.C. 154(b) by 266 days.

(21) Appl. No.: 12/737,197

(22) PCT Filed: Jul. 24, 2009

(86) PCT No.: PCT/EP2009/005629

§ 371 (c)(1),
(2), (4) Date: Dec. 16, 2010

(87) PCT Pub. No.: WO2010/012505

PCT Pub. Date: Feb. 4, 2010

(65) Prior Publication Data

US 2011/0088614 A1 Apr. 21, 2011

(30) Foreign Application Priority Data

Jul. 29, 2008 (IT) ..... MI2008A1392

(51) Int. Cl.
*B05B 15/04* (2006.01)
*B05C 19/00* (2006.01)

(52) U.S. Cl.
USPC ..... 118/309; 118/308

(58) Field of Classification Search
USPC ..... 118/308, 309, 326, 634, 50, DIG. 7, 118/61–64; 427/472, 479, 301; 454/50, 454/53; 55/DIG. 46
See application file for complete search history.

(56) References Cited

U.S. PATENT DOCUMENTS

| | | | |
|---|---|---|---|
| 5,690,995 | A | 11/1997 | Fischli |
| 6,187,098 | B1 | 2/2001 | Kraemer |
| 2002/0050245 | A1 | 5/2002 | Kraemer |

FOREIGN PATENT DOCUMENTS

| | | | |
|---|---|---|---|
| WO | WO2007/035656 | A | 3/2007 |

OTHER PUBLICATIONS

PCT Search Report dated Nov. 19, 2009.

*Primary Examiner* — Yewebdar Tadesse
(74) *Attorney, Agent, or Firm* — Hedman & Costigan, P.C.; James V. Costigan; Kathleen A. Costigan

(57) ABSTRACT

A powder painting cabin (10) of the type which comprises: a mantle (11) closed above by a roof (12) and below by a base (13), in said mantle (11) there being a passage (14) through which the pieces to be painted (15) pass and passages (19) for retractable powder supplier elements (18), and an air suction duct (30) of the cabin (10). Inside said mantle (11) there is a movable septum (22) between a lowered position close to said base (13) and a raised position close to said roof (12), said two lowered and raised positions defining, with the mantle (11), roof (12) and bottom (13), peripheral passages (26) for the air sucked through the duct (30).

5 Claims, 4 Drawing Sheets

POWDER PAINTING CABIN

The present invention relates to a painting cabin using powders, equipped with a perfected automatic cleaning system.

Various types of powder painting cabins tending to have a perfected automatic cleaning system which allows a rapid change of colour, are known to experts in the field.

Cabins are known where the powder residues are eliminated by means of damp sponges, assembled on a framework having the profile of a cabin and translated from one side to the other.

Axially rotating cylindrical cabins equipped with cleaning doctor blades, cylindrical cabins having a vertical axis with cleaning of the bottom by means of compressed air nozzles, cabins with a vibrating floor, cabins with a sucked moving belt and many others, are also known.

A powder painting cabin of the known type is described and illustrated for example in EP 1656998 B1.

These plants are complex, cumbersome, costly, difficult to use, and in any case require further manual final cleaning operations, after the automatic operations.

The average colour-change time in the known systems indicated above generally varies from 10 to 20 minutes.

In addition, environmental hygiene regulations are becoming increasingly stricter and tend to avoid manual cleaning operations in the presence of powders and chemical products.

An objective of the present invention is to overcome the drawbacks of the known art and in particular to:

completely avoid manual cleaning operations;

avoid powder dispersions in the environment;

allow a colour change in a time of less than 5 minutes;

produce constructively simpler cabins; and reduce the cabin maintenance to the minimum.

The above objective is achieved by a cabin having the characteristics indicated in the main claim and enclosed subclaims.

The structural and functional characteristics of the cabin according to the invention, and its advantages with respect to the known art, will appear more evident from the following description referring to the enclosed schematic drawings, which illustrate practical embodiment examples of the same invention.

With reference to the drawings, an example of a painting cabin with the use of powders produced according to the invention is indicated as a whole with 10 and can have, for example, a cylindrical form, but also other different forms suitable for the purpose, for example polygonal. The cabin 10 is structurally made up of a mantle 11 with a roof (12) and a bottom (base) 13, both conical.

Figure 1:
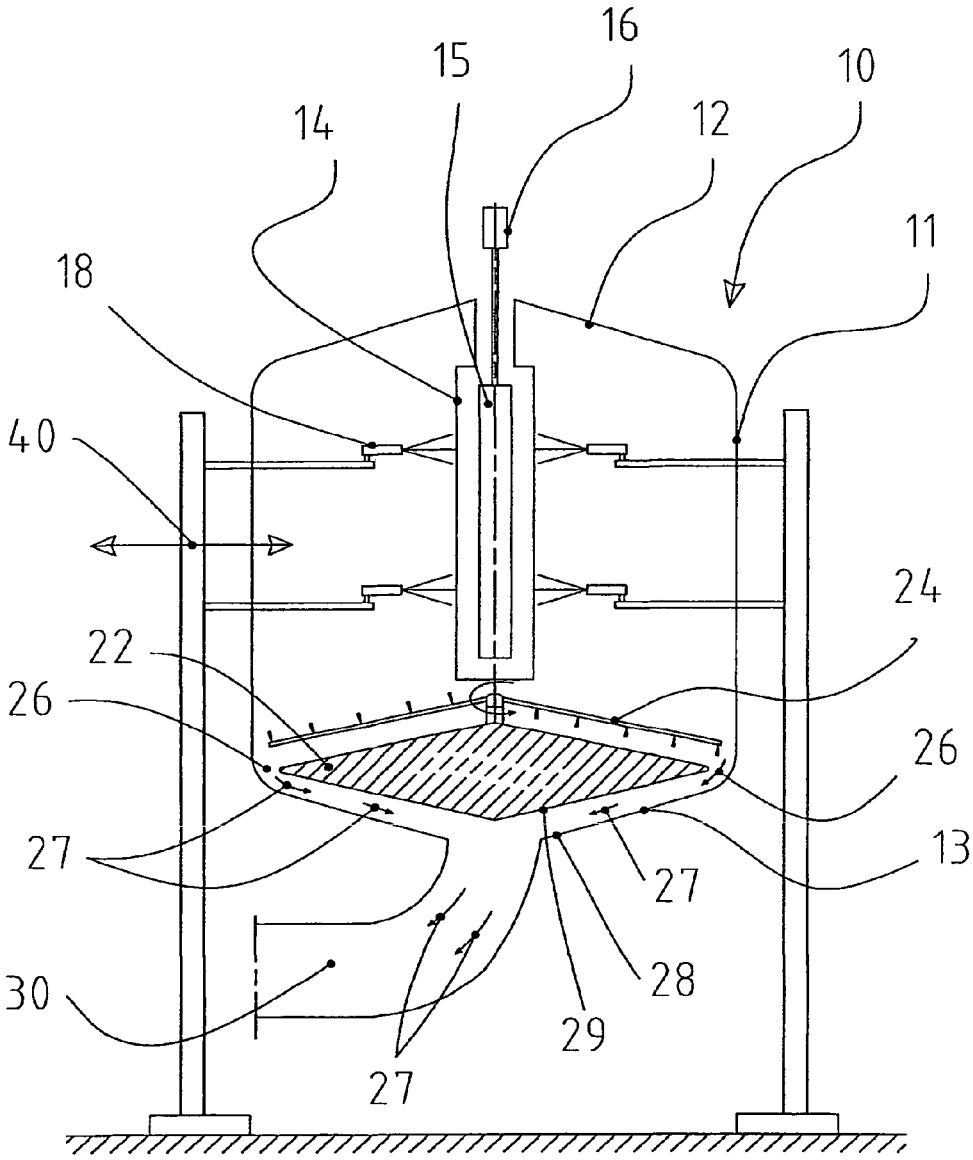
FIG. 1 is a vertical section illustrating an example of a cabin produced according to the principles of the present invention in the operative painting phase of an item.
Figure 3:
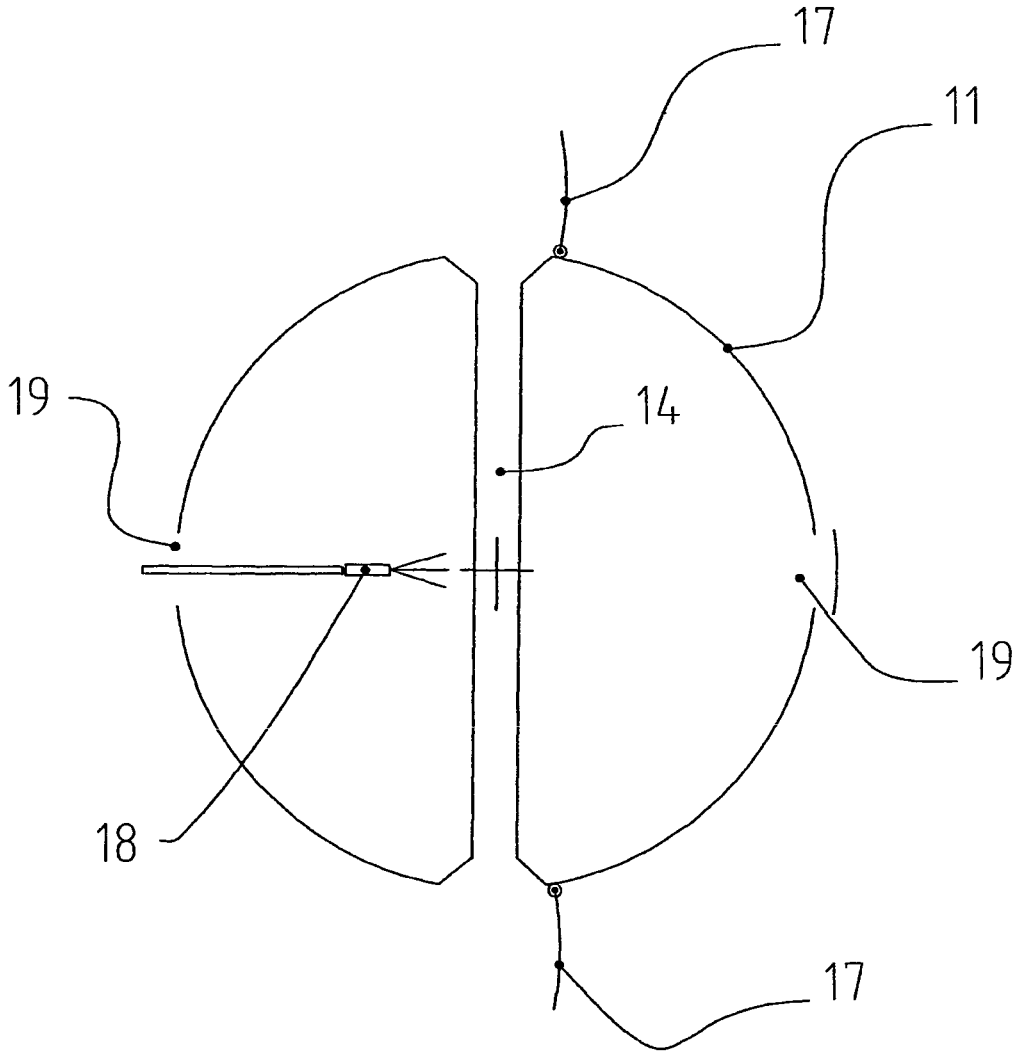
FIG. 3 is a plan view of the cabin of FIGS. 1, 2.

As can be clearly seen in FIGS. 1, 3, the cabin 10 has a diametric passage 14 which lies on a plane passing through the axis A with a vertical symmetry of the cabin itself.

The item to be painted 15 passes through said passage 14, which is carried by a conveying system of the known type schematized with 16.

As shown in the plan of FIG. 3, said passage 14 is equipped with closing doors 17 of the cabin during the cleaning phase.

18 indicates elements of the known type for supplying the painting powder, which are retractably introduced inside the cabin 10 through opposite diametric passages 19 situated in the mantle 11.

Figure 4:
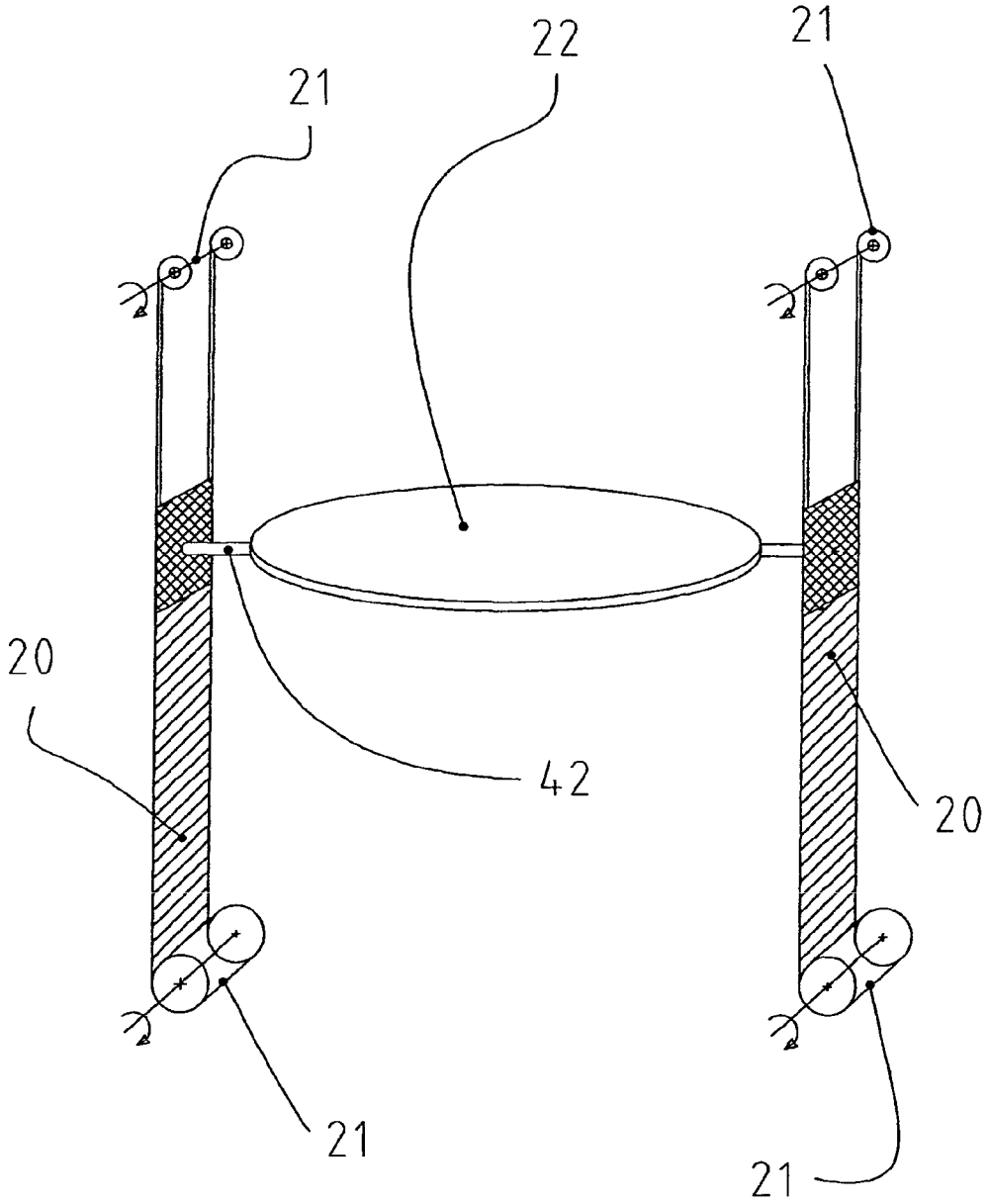
FIG. 4 is a scheme of the moving system of the moveable cleaning septum.

Said passages 19 lie on a plane passing through the axis A of the cabin, which is perpendicular to the plane on which the passage 14 lies. The passages 19 are provided with respective closing systems each comprising a vertical rolling shutter 20 consisting of a tape made of plastic material pulled between motorized terminal winding rolls 21 and driven to translate vertically upwards and downwards (FIG. 4).

According to the invention, between the shutters 20 a septum 22 is also fixed in 42, which, in the example shown, has a biconical configuration, which is also consequently driven to vertically translate upwards and downwards inside the cylindrical cabin 10.

Above said septum 22 there are also motorized arms 24 rotatingly hinged in 23, equipped with ejection nozzles 25 of cleaning compressed air.

As can be clearly seen from FIG. 1 of the drawings, the septum 22, in a lowered position, defines, with the bottom 13 and mantle 11, a narrow annular passage 26 through which the air present inside the cabin 10 is sucked, according to the arrows 27, through a suction duct 30 connected to sucking means (not shown).

The cabin 10 is thus kept in depression.

The functioning of the cabin according to the invention is clear from the above description with reference to the figures and is briefly the following.

The cabin in the painting phase is in the position of FIG. 1.

The biconical septum 22 is lowered close to the opposite bottom 13, consequently the width of the annular passage defined 26 and the divergence of the opposite walls 28, 29 of the bottom 13 and septum 22 are such as to create a Venturi effect which significantly accelerates the stream of air sucked in the direction of the arrows 27 through the suction duct 30.

In the painting phase, the compressed air ejection nozzles 25 can also be functioning.

At the end of the painting phase, the powder-supply elements 18, moveable in the directions of the arrow 40, are extracted from the cabin and the diametric passage 14 is closed by means of the doors 17, all with air suction and the nozzles 25 functioning.

Figure 2:
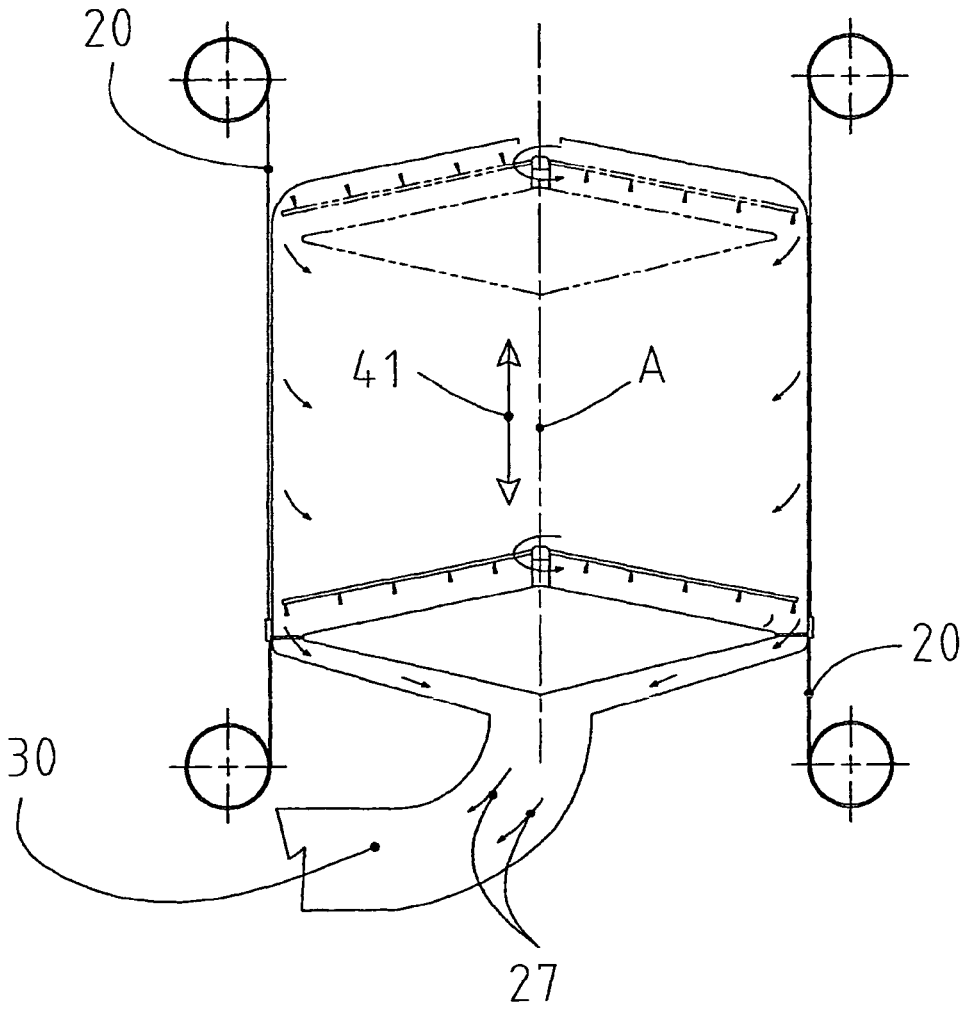
FIG. 2 is a vertical section illustrating the cabin of FIG. 1 in the automatic cleaning phase.

The movement system of the biconical septum 22, is also put into function, which sweeps the cabin vertically, upwards and downwards, in the directions of the arrow 41 (FIG. 2), thus effecting an automatic and complete cleaning of all the internal walls of the cabin, comprising the roof 12. As already explained, the same movement system of the disk entrains the taped shutter 20 closing the passages 19 of the powder-supply elements 18.

At the end of the above automatic cleaning phase of all the internal surfaces of the cabin—a simple and rapid cleaning, and without any manual intervention—the same cabin is ready for the application of a new colour, different from the previous one.

The objective mentioned in the preamble of the description is thus achieved.

The protection scope of the invention is defined by the following claims.

The invention claimed is:

1. A powder painting cabin (10) of the type which comprises: a mantle (11) closed above by a roof (12) and below by a base (13), there being a passage (14) in said mantle (11) through which the items to be painted (15) pass and passages (19) for retractable powder-supplier elements (18), and an air suction duct (30) of the cabin (10), characterized in that inside said mantle (11) there is a movable septum (22) between a lowered position close to said base (13) and a raised position close to said roof (12), said two lowered and raised positions defining, with the mantle (11), roof (12) and bottom (13), peripheral passages (26) for the air sucked through the duct (30) wherein said septum (22) has a biconical configuration, and that said root (12) and base (13) have a conical configuration.

2. The cabin according to claim 1, characterized in that the interspaced facing surfaces (28, 29) of the base (13) and septum (22) respectively, are divergent, thus creating a venturi effect in the sucked air.

3. The cabin according to claim 2, characterized in that said surfaces (28, 29) are conical.

4. The cabin according to claim 1, characterized in that compressed air ejection nozzles (25) are associated with said septum (22).

5. The cabin according to claim 1, characterized in that the upper surface of said septum (22) is equipped with rotating arms (24) carrying compressed air ejection nozzles (25).

* * * * *